US005285709A

United States Patent [19]

Grant

[11] Patent Number: 5,285,709

[45] Date of Patent: Feb. 15, 1994

[54] MACHINE HEAD FOR TUNING A STRINGED INSTRUMENT, ESPECIALLY A GUITAR OR THE LIKE

[76] Inventor: John D. Grant, 8 South Rd., Lancaster, LA1 4XD, United Kingdom

[21] Appl. No.: 671,835

[22] PCT Filed: Sep. 20, 1989

[86] PCT No.: PCT/GB89/01101

§ 371 Date: Mar. 28, 1991

§ 102(e) Date: Mar. 28, 1991

[87] PCT Pub. No.: WO90/03637

PCT Pub. Date: Apr. 5, 1990

[30] Foreign Application Priority Data

Sep. 29, 1988 [GB] United Kingdom ..... 8822819

[51] Int. Cl.[5] ..... G10D 3/00; G10D 3/14

[52] U.S. Cl. ..... 84/297 R; 84/306

[58] Field of Search ..... 84/297 R, 304, 306

[56] References Cited

U.S. PATENT DOCUMENTS

| | | | |
|---|---|---|---|
| 2,304,597 | 8/1942 | Proelsdorfer | 84/297 R |
| 2,356,766 | 4/1943 | Kluson | 84/306 |
| 3,407,696 | 10/1968 | Smith et al. | 84/297 R |
| 3,596,552 | 8/1971 | Lager | 84/297 R |

FOREIGN PATENT DOCUMENTS

| | | |
|---|---|---|
| 2537317 | 6/1984 | France . |
| 659299 | 11/1951 | United Kingdom . |

*Primary Examiner*—Michael L. Gellner
*Assistant Examiner*—Cassandra Spyrou
*Attorney, Agent, or Firm*—Ware, Fressola, Van Der Sluys & Adolphson

[57] ABSTRACT

A machine head, especially for precision tuning of a guitar string or strings, avoids the slackness between the cog and worm gear drive of the existing design which can give rise to tuning slip and imprecise tuning. The proposed machine head has a spindle to which a string is secured at one end and carries an arm (2*a*). Adjusting screw (3) cooperates threadingly with an abutment (7) and the end of the adjusting screw bears on the arm whereby rotation of the adjusting screw determines the position of the arm and hence tension in the string.

22 Claims, 2 Drawing Sheets

MACHINE HEAD FOR TUNING A STRINGED INSTRUMENT, ESPECIALLY A GUITAR OR THE LIKE

BACKGROUND OF THE INVENTION

This invention relates to a machine head for tuning a stringed instrument especially a guitar or the like. Traditionally the guitar string is tensioned and tuned using a 'machine head' which consists of a vertical spindle which can be rotated by means of a worm gear-cog assembly. The 'machine head' is fixed to the head of the guitar and the string is fed through a hole in the spindle and is wound onto it using the worm gear-cog system. The string is thus tensioned as the other end is fixed immovably at the body end of the guitar. Tensioning continues until the right musical note is sounded.

The drawback of the traditional system is that slackness between the cog and the worm can cause tuning slip and unprecise tuning. It has been accepted without question that a worm drive is required to provide sufficient adjustment and consequently the above system has become universally accepted for guitars or the like despite the short comings.

SUMMARY OF THE INVENTION

It is an aim of the present invention to provide a machine head which overcomes the short comings of the prior art.

According to one embodiment of the present invention there is provided a machine head for a stringed instrument, such as a guitar which can be fitted to a guitar for purposes of tensioning and so tuning up a guitar string. The string is passed round and secured to a spindle (preferably vertical). The spindle can be rotated by means of a screw which pushes on a curved arm that is attached to the spindle.

The lateral (relative to a guitar head) movement of the screw is converted to rotational movement by means of this arm so that it is possible to rotate the spindle through about a quarter of a turn (90 degrees arc of rotation). The section of the spindle that the string goes round is of sufficient circumference (in the order of 25 mm–35 mm) so that the slack can be taken out of the string and stretch allowed for so that the string can attain the required tension within the adjustment allowed. A number of machine head assemblies can be mounted on a common carrier.

Accordingly, the present invention also provides a machine head for a multi stringed instrument comprising for each string a rotatable spindle and screw threaded adjusting means therefor acting between an arm of the spindle and an abutment therefor, and wherein the abutment for two or more adjusting means is carried by a common carrier adapted to be secured to the instrument head.

Contrary to the accepted understanding, a quarter of a turn provides quite sufficient adjustment facility so enabling the worm-cog system to be dispensed with. Of course, it would be feasible to incorporate a one way ratchet over into the arm/spindle drive train to allow for take up of excess slack, although I have found this to be completely unnecessary.

This turning system permits more precise tuning than the traditional system and the tuning is more stable as the device is unable to detune as it is stopped against the tuning screw. Tension in the string urges the arm against the adjusting screw to maintain the setting. A lock nut or other locking system could be incorporated if desired. The screw action provides much finer tuning as four turns of the screw is equivalent to one of the traditional system.

BRIEF DESCRIPTION OF THE DRAWINGS

A specific embodiment of the invention will now be described by way of example only with reference to the accompanying drawings in which.

DETAILED DESCRIPTION OF THE PREFERRED EMBODIMENT

Figure 1:
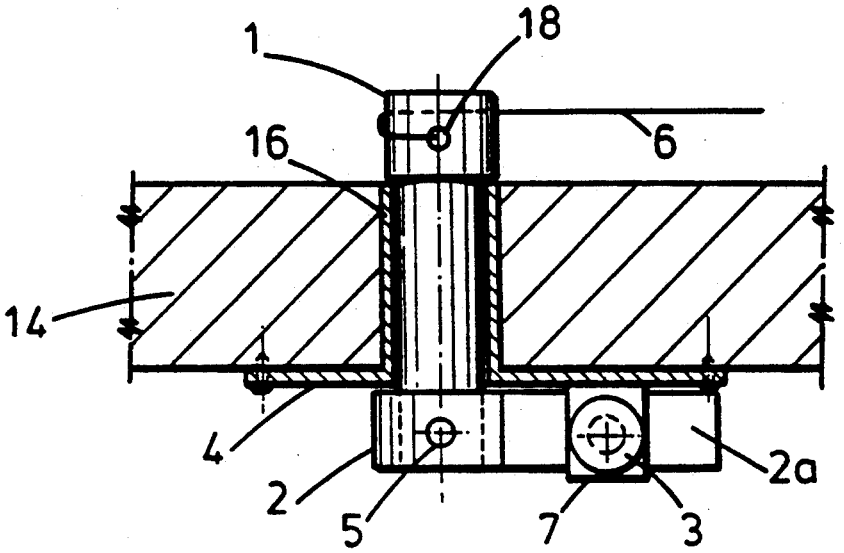
FIG. 1 shows a cross-sectional view of the tuning system of the present invention (one string only shown by way of example)
Figure 2:
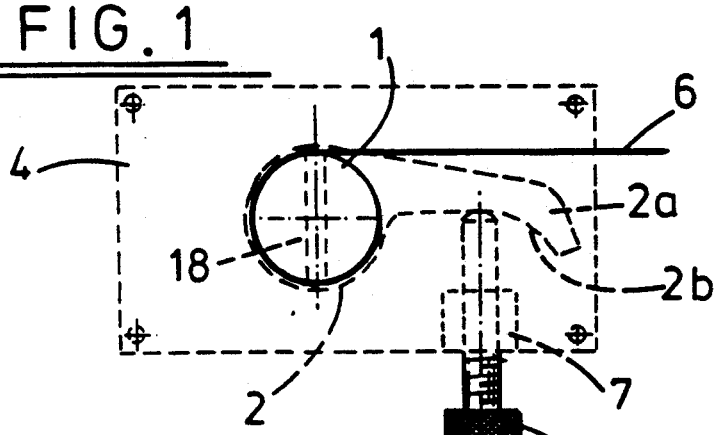
FIG. 2 shows a top view of the system (backplate shown in dotted line) demonstrating the adjusting screw pushing on the curved arm.
Figure 3:
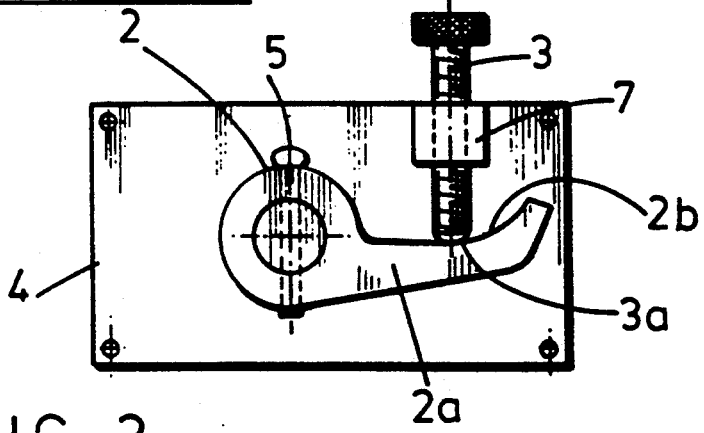
FIG. 3 shows the bottom view as in FIG. 2.

Referring to the drawings, the invention is described by way of example with reference to the preferred application, namely as a guitar machine head, although it will be appreciated that it could be used for other stringed instruments. The machine head comprises a backplate 4 which is fitted to the reverse of the guitar head 14. A bearing surface (sleeve bearing 16) is attached to the backplate 4 and is inserted into a hole in the guitar head (see FIG. 1). A spindle 1 passes through the bearing surface in relation to which it is journalled, and has a enlarged outermost end. A sleeve 2 (with curved arm 2*a*) is slipped over the other end of the spindle 1 and is secured to it by means of a split pin 5 which passes through a hole common to both the spindle 1 and the sleeve 2 (see FIG. 5). The curved arm 2*a* of the sleeve 2 rests against an adjusting screw 3 which passes through a threaded mounting 7 which is conveniently carried on the backplate 4. The arm 2*a* has a curved surface 2*b* and the adjusting screw 3 has a curved end 3*a* which engages the curved surface 2*b*.

Figure 4:
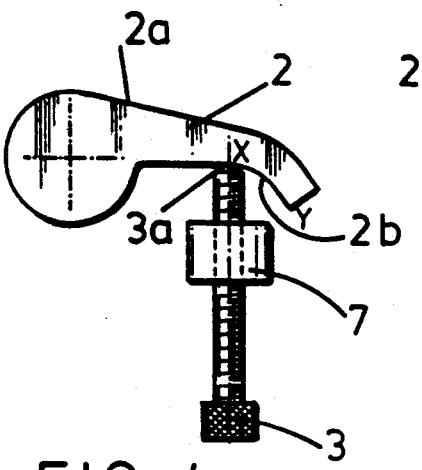
FIG. 4 and FIG. 5 demonstrate how the sleeve (with curved arm) moves by the action of the adjusting screw.
Figure 5:
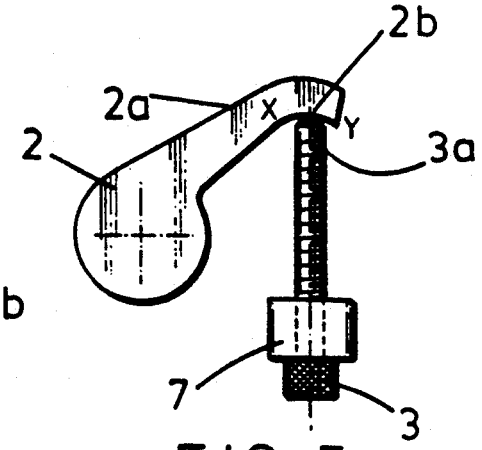

To string and tune the guitar, the following proceedure is adopted. With the adjusting screw 3 fully slackened off, a string 6 is tensioned as much as possible by hand, then wound round the enlarged outermost end of the spindle 1 and passed through a hole 18 in the top of the spindle 1 then is nipped under a loop of the string 6. The adjusting screw 3 is then adjusted to push on the sleeve arm 2*a* (FIGS. 4 and 5). The rounded head of the adjusting screw 3 follows the curve XY (see FIGS. 4 and 5) which is so designed that the curve is tangential to the screw 3 at whatever position the screw 3 is in. The system rotates counterclockwise and puts the string 6 under tension. The enlarged outermost end of the spindle 1 is of such a diameter that all the adjustment required is accommodated in a quarter of a turn of the spindle 1 (90 degrees arc of rotation). The string 6 can then be adjusted up to concert pitch and tuning adjustments can be made as required by slackening or tightening the screw 3.

Figure 6:
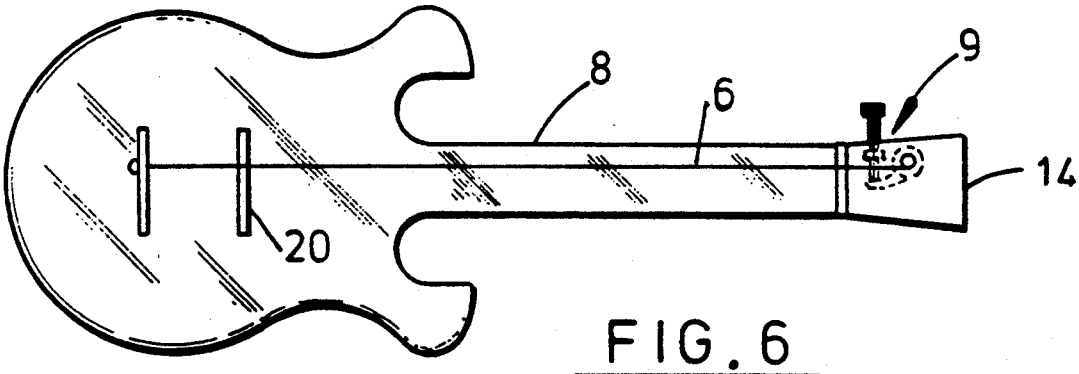
FIG. 6 shows a guitar with the tuning system thereon (one string only shown)

FIG. 6 shows how the string 6 is fixed to the body end of the guitar 8, passed over the bridge 20 up to the nut and hence to the tuning mechanism generally indicated by the numeral 9.

Figure 7:
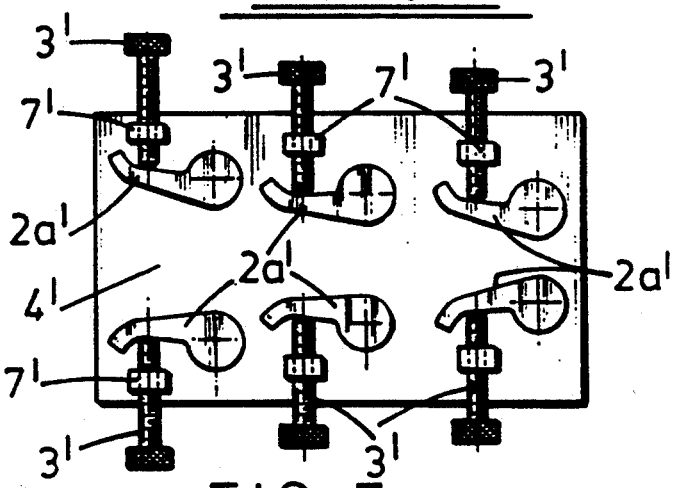
FIG. 7 is a bottom view illustrating six machine head assemblies mounted on a common carrier.

It will be understood that the back plate could carry several spindles and adjusting means and FIG. 7 describes one possible example from which it will be seen that the back plate 4' carries six string spindles with associated arms 2a' and respective adjusting screws 3' threaded through respective abutments 7'.

I claim:

1. A machine head for fitting to a stringed instrument for tensioning and so tuning up a string, the machine head comprising:

a spindle around which the string is passed and to which the string is secured, the spindle having a longitudinal axis;

means mounting the spindle for rotation about the longitudinal axis;

a single arm extending from the spindle; and screw threaded adjusting means including a threaded member which threadingly engages an abutment and a free end which engages the arm, for displacing the arm and thereby rotating the spindle about its longitudinal axis to pull the string around the spindle and tension the string.

2. A machine head as claimed in claim 1 in which the arm has a curved surface which is tangential to a point of engagement by the free end of the threaded member.

3. A machine head as claimed in claim 1 in which the free end of the threaded member has a curved surface to engage the arm.

4. A machine head as claimed in claim 3 in which the arm is fixedly secured to the spindle.

5. A machine head as claimed in claim 4 in which the string is secured to an end of the spindle which has a circumference of 25 mm to 35 mm.

6. A machine head as claimed in claim 5 in which the spindle has a hole adjacent the end to accommodate the string in securing thereof to the spindle.

7. A machine head as claimed in claim 6 in which the screw threaded adjustment means is carried by a plate which is adapted to be secured to a head of the instrument.

8. A machine head as claimed in claim 1 in which the spindle mounting means is a sleeve bearing in which the spindle is journalled.

9. A machine head as claimed in claim 1 in which the free end of the threaded member has a curved surface to engage the arm.

10. A machine head as claimed in claim 1 in which the arm is fixedly secured to the spindle.

11. A machine head as claimed in claim 1, wherein the threaded member is rectilinearly moveable along an axis offset with respect to the longitudinal axis of the spindle.

12. A machine head as claimed in claim 11, wherein the arm is located on one end of the spindle and the string is located on another end thereof.

13. A machine head as claimed in claim 1, wherein the arm is located on one end of the spindle and the string is located on another end thereof.

14. A machine head as claimed in claim 13 in which the another end of the spindle to which the string is secured has a circumference of 25 mm to 35 mm.

15. A machine head as claimed in claim 1 in which the spindle has a hole adjacent one end to accommodate the string in securing thereof to the spindle.

16. A machine head as claimed in claim 1 in which the screw threaded adjustment means is carried by a plate which is adapted to be secured to a head of the instrument.

17. A machine head as claimed in claim 16 in which the plate carries the spindle mounting means including a sleeve bearing in which the spindle is journalled.

18. A machine head for an instrument having a plurality of strings comprising:

(a) a carrier adapted to be secured to the instrument; and (b) a string tensioning device located on the carrier for each of the plurality of strings, each said string tensioning device comprising:

(i) a spindle around which one respective string is passed and to which the respective string is secured, the spindle having a longitudinal axis;

(ii) means mounting the spindle for rotation about the longitudinal axis;

(iii) a single arm extending from the spindle; and (iv) screw threaded adjusting means including a threaded member which threadingly engages an abutment and a free end which engages the arm, for displacing the arm and thereby rotating the spindle about the longitudinal axis to pull the respective string around the spindle and tension the respective string.

19. A machine head as claimed in claim 18, wherein, for each said string tensioning device, the threaded member is rectilinearly moveable along an axis offset with respect to the longitudinal axis of the spindle.

20. A machine head as claimed in claim 19, wherein, for each said string tensioning device, the arm is located on one end of the spindle and the string is located on another end thereof.

21. A machine head as claimed in claim 18, wherein, for each said string tensioning device, the arm is located on one end of the spindle and the string is located on another end thereof.

22. A machine head for fitting to a stringed instrument for tensioning and so tuning up a string, the machine head comprising:

a spindle having a string attachment end around which the string is passed and to which the string is secured, the spindle having an adjustment end and a longitudinal axis;

means mounting the spindle for rotation about the longitudinal axis;

a single arm extending from the adjustment end of the spindle; and screw threaded adjusting means for displacing the arm and thereby rotating the spindle about the longitudinal axis to pull the string around the spindle and tension the string, the screw threaded adjustment means including a threaded member which threadingly engages an abutment and a free end which engages the arm, when displacing the arm.

* * * * *